US012454034B1

(12) United States Patent
Kasper, Jr.

(10) Patent No.: US 12,454,034 B1
(45) Date of Patent: Oct. 28, 2025

(54) GRINDING WHEEL DRESSING TOOL WITH HOLLOW SPHERES

(71) Applicant: Edward O. Kasper, Jr., Helenville, WI (US)

(72) Inventor: Edward O. Kasper, Jr., Helenville, WI (US)

( * ) Notice: Subject to any disclaimer, the term of this patent is extended or adjusted under 35 U.S.C. 154(b) by 0 days.

(21) Appl. No.: 19/191,269

(22) Filed: Apr. 28, 2025

(51) Int. Cl.
*B24B 53/12* (2006.01)
*B24B 53/02* (2012.01)
*B24B 53/053* (2006.01)

(52) U.S. Cl.
CPC ..... *B24B 53/053* (2013.01); *B24B 53/02* (2013.01); *B24B 53/12* (2013.01)

(58) Field of Classification Search
CPC ..... B24B 53/02; B24B 53/04; B24B 53/047; B24B 53/06; B24B 53/12; B24D 18/009
USPC ..... 451/72, 443
See application file for complete search history.

(56) References Cited

U.S. PATENT DOCUMENTS 2,404,184 A * 7/1946 Ludel ..... B24D 3/08 125/39
2,443,370 A * 6/1948 Bakker ..... B24B 53/12 125/39
2,662,519 A * 12/1953 Metzger ..... B24B 53/12 51/309
4,805,586 A * 2/1989 Borse ..... B24B 53/12 51/293
8,568,499 B2 * 10/2013 Nagata ..... B24D 3/18 51/293
2004/0112359 A1 * 6/2004 Sung ..... B24B 53/017 125/15
2016/0311083 A1 * 10/2016 Kasuga ..... B24D 5/02
2024/0308025 A1 9/2024 Nagami

FOREIGN PATENT DOCUMENTS

JP 2003053668 A * 2/2003

OTHER PUBLICATIONS

Naoki, JP-2003053668-A machine translation, Feb. 26, 2003 (Year: 2003).*

* cited by examiner

*Primary Examiner* — Brian D Keller
*Assistant Examiner* — Marcel T Dion
(74) *Attorney, Agent, or Firm* — Donald J. Ersler

(57) ABSTRACT

A grinding wheel dressing tool with hollow spheres preferably includes a tool shank and a dressing portion. The tool shank preferably includes a shank portion and a tool body. The shank portion extends from one end of the tool body and a dressing portion cavity is formed in an opposing end. The dressing portion preferably includes a quantity of diamond grit, metal bond powder, binder and a plurality of hollow spheres. The dressing portion cavity is preferably filled to a top with metal bond powder. The diamond grit, the metal bond powder and the binder are mixed together to form a grit mixture. A tubular mold is slipped over a top of the tool body. The dressing portion is created by forming alternative layers of grit mixture and hollow spheres in the tubular mold. The tubular mold is heated and the grit mixture pressed with a plunger.

9 Claims, 2 Drawing Sheets

FIG. 6
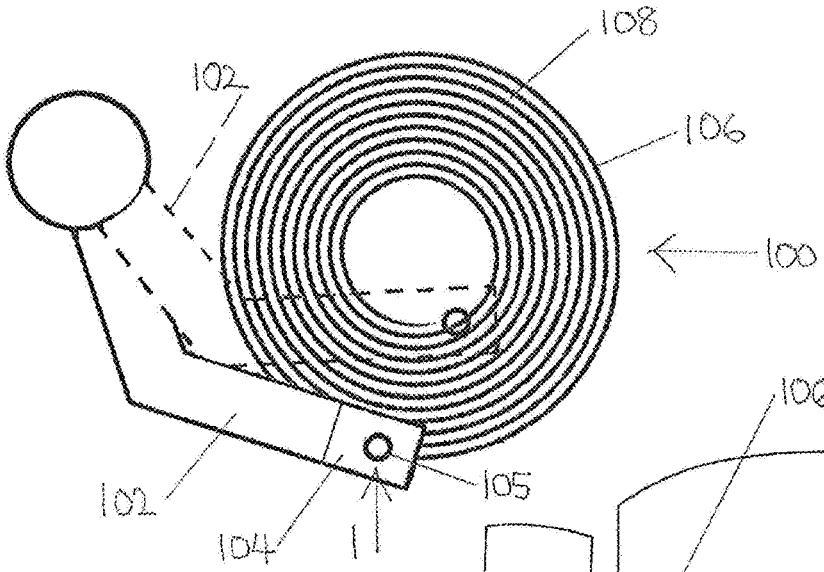
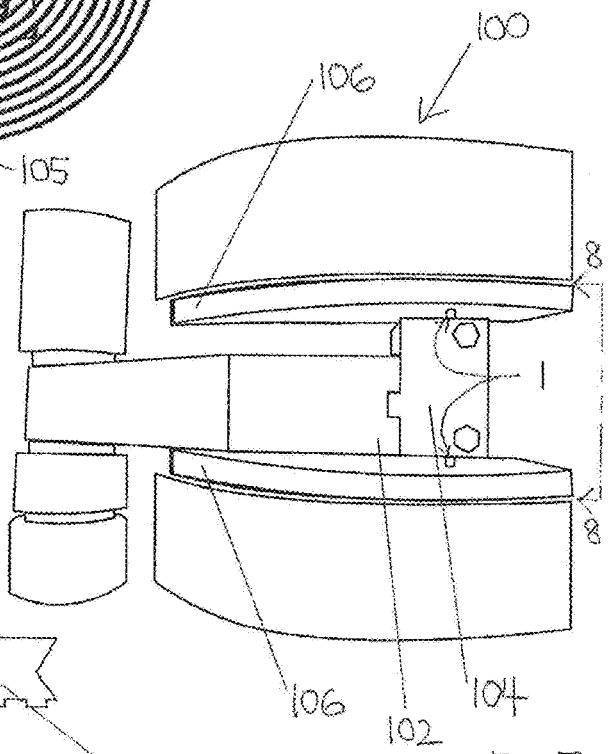
FIG. 7
FIG. 8
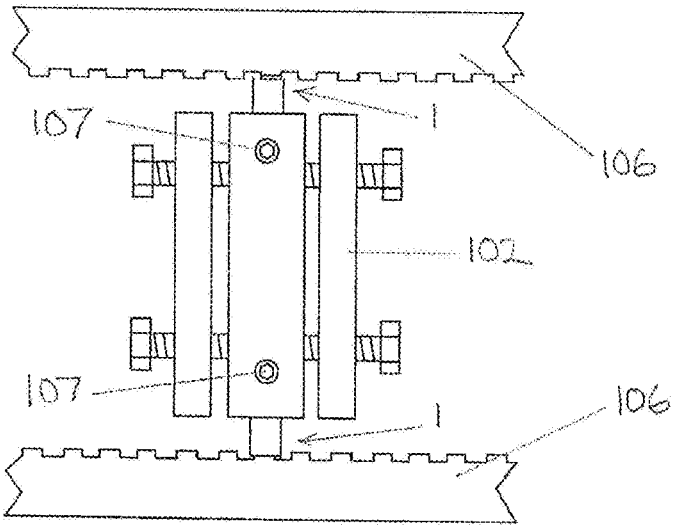

GRINDING WHEEL DRESSING TOOL WITH HOLLOW SPHERES

BACKGROUND OF THE INVENTION

1. Field of the Invention

The present invention relates generally to grinding of metal parts and more specifically to a grinding wheel dressing tool with hollow spheres, which takes less time to dress a grinding wheel than that of the prior art.

2. Discussion of the Prior Art

Grinding remains an integral part of manufacturing due to its efficient and controllable removal of material when forming a workpiece. The focus of the grinding may be to form, size, control surface finish, or productivity for removal of stock from a workpiece. The grinding wheel is a composite of abrasive grains and the bond that holds them together. When a grinding wheel is made for a particular application, it becomes more complex. The size and type of abrasive grain, the type of bond, the structure of the wheel, the spacing of the grains, and the hardness of the bond are all taken into consideration in the manufacture of the grinding wheel. The abrasive grains are the cutting edges that remove material from the workpiece. If the grinding wheel is developed appropriately and the grinder is set up correctly, as the grains become dull, they will break out of the bond and new sharp grains will be exposed to provide efficient material removal.

Grinding wheel maintenance in the form of dressing is necessary when the grains are no longer cutting efficiently or the wheel has developed a shape due to grain attrition, usually at the point of greatest stock removal. There are various types of dressers that have been used to dress the wheel to its desired shape and expose new, sharp grains. Single and multi-point diamond dressers, metal bond diamond grit impregnated dressers, wheel dressers, and star or disc cutters are tools used to dress grinding wheels. The general rule of thumb is that grinding wheels made with abrasive grains that are finer than 60 grit should be dressed with diamond dressers. Coarser grinding wheels should be dressed with stars or disc cutters. If a diamond dresser is used to dress a coarse grinding wheel, the surface of the grinding wheel becomes too smooth which will result in poor stock removal and an excessive amount of heat that will transfer to the piece part.

Star cutters and discs are stamped steel parts that spin freely on a shaft between bearings and is attached to a dressing arm or fixture and rubbed against the spinning grinding wheel to break out the dull grains. It is difficult and time consuming to dress large disc wheels where the flat side of the wheel does the grinding. It can take more than an hour to dress the grinding wheel. Manufacturers of springs use double disc grinder wheels to grind both ends of the spring at the same time to make them flat and parallel. Any grinding wheel shape will affect both the length of the spring and the parallelism of the opposing ends. Because the stars break out the grains by force, there is an uneven surface to the face of the grinding wheel. Dressing aids in stock removal, because the grinding wheel becomes coarser due to the exposed grains, but the hills and valleys created by the dressing tool become exacerbated and create issues with flatness and the length of time for accomplishing the grinding of the workpiece. Dressing the grinding wheels is non-productive machine time and when it is done several times a shift, it will significantly add to the cost of the piece part.

U.S. Pat. Nos. 2,404,184, 2,443,370 and 2,662,519 disclose older grinding wheel dressing tools. Patent publication no. 2024/0308025 to Nagami discloses a dressing member, which includes spheres having a diameter of no greater than 300 micrometers. Further, the Nagami dressing tool is rotated during the dressing of a grinding wheel.

Accordingly, there is a clearly felt need in the art for a grinding wheel dressing tool with hollow spheres, which dresses a coarse grinding wheel faster than prior art dressing tools; lasts longer than prior art dressing tools; and takes less time to replace than prior art dressing tools.

SUMMARY OF THE INVENTION

The present invention provides a grinding wheel dressing tool with hollow spheres, which dresses a coarse grinding wheel and lasts longer than prior art dressing tools. The grinding wheel dressing tool with hollow spheres (hollow sphere dressing tool) preferably includes a tool shank and a dressing portion. The tool shank preferably includes a shank portion and a tool body. The shank portion extends from one end of the tool body and a dressing portion cavity is formed in an opposing end of the tool body. A center drill bit is preferably used to create the dressing portion cavity, but other tools could also be used. The dressing portion preferably includes a quantity of diamond grit, metal bond powder, binder and a plurality of hollow spheres. A diameter of the spheres preferably have a range of about 3-5 mm, but other dimensions could also be used. The hollow spheres are preferably fabricated from aluminum oxide, but other materials could also be used, such as glass spheres. The dressing portion cavity is preferably filled to a top with metal bond powder. The diamond grit and the metal bond powder are mixed together and wetted with the binder to form a grit mixture. A tubular mold is slipped over a top of the tool body. The tubular mold includes a through bore, which is the same diameter as the dressing portion cavity and a counterbore is sized to receive an outer diameter of the tool body. The tubular mold is preferably fabricated from graphite, but other materials may also be used.

The grit mixture is applied to a top of the metal bond powder in a first layer. A plurality of hollow spheres are applied to a top of the first layer of grit mixture in a first pattern. A second layer of grit mixture is applied to a top of the first layer of hollow spheres. The grit mixture layers preferably having a height, which is equal to a diameter of the hollow spheres. A second layer of the plurality of hollow spheres is applied to a top of the second layer of grit mixture. The second layer of the plurality of spheres is applied to the second layer of grit mixture in a second pattern, which is offset from the first pattern. A third layer of grit mixture is applied over the second layer of the plurality of hollow spheres.

A third layer of the plurality of hollow spheres are applied on top of the third layer of grit mixture in a third patter, which is offset from the second pattern. The grit mixture is applied around the third layer of hollow spheres to finish a top of the dressing portion. The tool body, the uncured dressing portion and the tubular mold are heated to about 1800 degrees Fahrenheit for a period of about five minutes and pressed. The heating cures the dressing portion and fuses the dressing portion to the tool body. A volume of the dressing portion will be reduced by about 50%.

The shank portion of the hollow sphere dressing tool is held in a bore of a dressing arm of a grinding machine. The dressing arm is a movable fixture that holds the hollow sphere dressing tool at an end of the dressing arm, like a stylus of a record player that holds the needle and moves across a vinyl record. The hollow spheres in hollow sphere dressing tool break during the dressing process and create voids in the dressing portion. The voids impart grooves into the grinding wheel similar to that of the grooves in the vinyl record. The diamond grit in the dressing portion cut away dull areas in the grinding wheel as opposed to breaking out the grains by force, creating a flatter grinding surface without the deformity of a fractured surface. The grooves in the grinding wheel provide an open structure necessary for heavy material removal. Because the wheel is dressed flat, the length of time between dresses increases significantly, thus reducing the cost of dressing from a stand point of reduced down time.

Accordingly, it is an object of the present invention to provide a hollow sphere dressing tool, which dresses a coarse grinding wheel faster than prior art dressing tools.

It is a further object of the present invention to provide a hollow sphere dressing tool, which lasts longer than prior art dressing tools.

Finally, it is another object of the present invention to provide a hollow sphere dressing tool, which takes less time to replace from a dressing arm than prior art dressing tools.

These and additional objects, advantages, features and benefits of the present invention will become apparent from the following specification.

BRIEF DESCRIPTION OF THE DRAWINGS

FIG. 6 is a top view of a grinding machine with a hollow sphere dressing tool retained in a dressing arm and the dressing arm treating a lower grinding wheel of the grinding machine in a start position and in an end position.

FIG. 7 is an enlarged side view of a dressing arm retaining two hollow sphere dressing tools in accordance with the present invention.

FIG. 8 is an enlarged end view of a dressing tool holder arm retaining two hollow sphere dressing tools in accordance with the present invention.

DETAILED DESCRIPTION OF THE PREFERRED EMBODIMENTS

Figure 1:
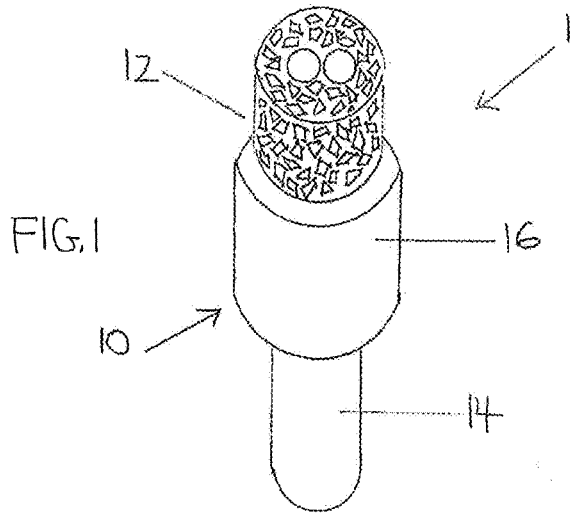
FIG. 1 is a top perspective view of a hollow sphere dressing tool in accordance with the present invention.
Figure 2:
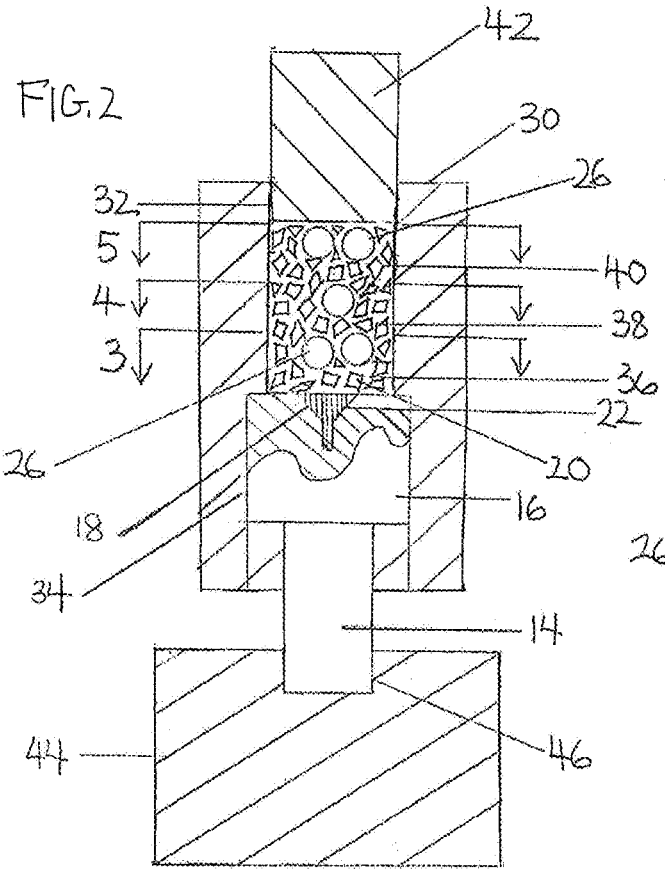
FIG. 2 is a cross sectional view of a hollow sphere dressing tool with a tubular mold applied thereto, illustrating multiple layers of a dressing portion in accordance with the present invention.

With reference now to the drawings, and particularly to FIG. 1, there is shown a perspective view of a hollow sphere dressing tool 1. The hollow sphere dressing tool 1 preferably includes a tool shank 10 and a dressing portion 12. The tool shank 10 preferably includes a shank portion 14 and a tool body 16. With reference to FIG. 2, the shank portion 14 extends from one end of the tool body 16 and a dressing portion cavity 18 is formed in an opposing end of the tool body 16. A center drill bit is preferably used to create the dressing portion cavity 18, but other tools could also be used. The dressing portion 12 preferably includes a quantity of diamond grit 20, metal bond powder 22, binder 24 and a plurality of hollow spheres 26. A diameter of the spheres 26 preferably has a range of between 3-5 mm, but other dimensions could also be used. The spheres 26 are preferably fabricated from aluminum oxide, but other materials could also be used, such as glass.

Figure 3:
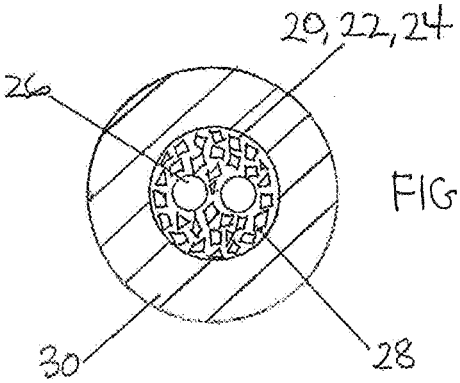
FIG. 3 is a top view of a first layer of hollow spheres of a hollow sphere dressing tool in accordance with the present invention.
Figure 4:
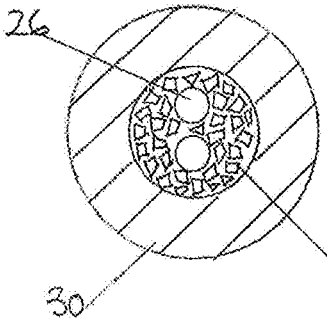
FIG. 4 is a top view of a second layer of hollow spheres of a hollow sphere dressing tool in accordance with the present invention.
Figure 5:
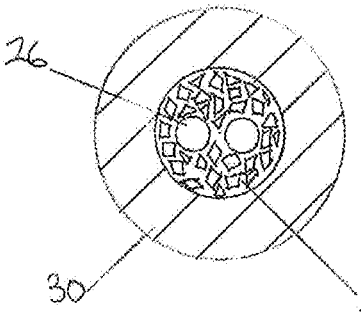
FIG. 5 is a top view of a second layer of hollow spheres of a hollow sphere dressing tool in accordance with the present invention.

With reference to FIGS. 3-5, the dressing portion cavity 18 is preferably filled to a top with the metal bond powder 22. The diamond grit 20 and the metal bond powder 22 are mixed together and wetted with the binder 24 to form a grit mixture 28. Satisfactory results have been achieved, when using Isopropyl alcohol for the binder 24, but other fluids may also be used. The percentage of weights of the diamond grit 20, the metal bond powder 22 and the binder 24 is dependent upon the piece part ground on the grinding wheel. Creating grit mixtures 28 is within the ability of one skilled in the art. A size of the diamond grit 20 is dependent upon the grinding wheel to be dressed. A tubular mold 30 is slipped over a top of the tool body 16. The tubular mold 30 includes a through bore 32, which is the same diameter as an outer diameter of the dressing portion cavity 18, and a counterbore 34 sized to receive an outer diameter of the tool body 16.

The grit mixture 28 is applied to a top of the metal bond powder 22 in a first layer 36. A plurality of hollow spheres 26 are applied to a top of the first layer 36 of the grit mixture 28 in a first pattern. A second layer 38 of the grit mixture 28 is applied to a top of the first layer of spheres 26. The grit mixture layers 36, 38, 40 preferably have a height, which is about equal to a diameter of the hollow spheres 26. A second layer of the hollow spheres 26 is applied to a top of the second layer 38 of the grit mixture 28. The second layer of the hollow spheres 26 is applied to the second layer 38 of the grit mixture 28 in a second pattern, which is offset from the first pattern of spheres 26. A third layer 40 of the grit mixture 28 is applied over the second layer of the hollow spheres 26. A third layer of the hollow spheres 26 is applied on top of the third layer 40 of grit mixture 28 in a third pattern, which is offset from the second pattern. The grit mixture 28 is applied around the third layer of hollow spheres 26 to finish a top of the dressing portion 12. The shank portion 14 is inserted into a bore 46 of a holding block 44. The tool body 16, the uncured dressing portion 12 and the tubular mold 30 are heated to about 1800 degrees Fahrenheit for a period of about five minutes and pressed with a plunger 42. The plunger 42 has a slip fit with the through bore 32. The tubular mold 30 and the plunger 42 are preferably made from graphite, but other materials may also be used. The heating cures the dressing portion 12 and fuses the dressing portion 12 to the tool body 16. A volume of the dressing portion 12 will be reduced by about 50%, which effectively stacks the hollow spheres 26 on top of each other, after the heating and pressing.

With reference to FIGS. 6-8, the shank portion 14 of the hollow sphere dressing tool 1 is held in a dressing arm 102. The dressing arm 102 includes a dressing tool holder 104. The dressing tool holder 104 includes at least one dressing tool bore 105 and at least one set screw 107, which communicates with the dressing tool bore 105. The shank portion 14 is inserted into the dressing tool bore 105 and the set screw 107 is tightened against the shank portion 14 to secure the hollow sphere dressing tool 1 in the dressing tool holder 104. The dressing tool holder 104 will also retain a star cutter tool. The dressing arm 102 is a movable fixture, similar to a tone arm of a record player. The hollow sphere dressing tool 1 acts like a stylus of a record player that holds the needle and moves across a surface of a record. The hollow spheres 26 in the dressing portion 12 break during the dressing process and create voids in a contact surface of the dressing portion 12. The voids have the unexpected result to impart grooves 108 into the grinding wheel 106 similar to the grooves in a vinyl record. The diamond grit 20 in the dressing portion 12 cuts away dull areas in the grinding wheel 106 as opposed to breaking out the grains by force, which creates a flatter grinding surface without the deformity of a fractured surface. The grooves 108 in the grinding wheel 106 provide an open structure necessary for heavy material removal. Because the grinding wheel 106 is dressed flat, the length of time between dresses increases significantly, thus reducing the cost of dressing from a reduced down time standpoint.

For example, on a grinding job where tolerances are tight, the difference between one dress per production shift with the hollow sphere dressing tool 1, as opposed to 5-6 dresses per shift with the prior art star cutter tool. The length of time required to dress the grinding wheel 106 is also significantly reduced. The time required to dress a grinding wheel 106 varies with the hardness of the grinding wheel 106 and the amount of surface area of the grinding wheel 106 that needs to be dressed to make it flat. With the prior star cutter tool, the dressing process can take anywhere between 20-60 minutes. Dressing with the hollow sphere dressing tool 1 takes between 5-10 minutes. The star cutter tool is made as an assembly, with the stars spinning freely on a shaft with bearings. When the stars need to be replaced, it takes about an hour to remove the stars from a star cutter tool. More time is required, if the shaft or bearings are worn and need machined or replaced. When the hollow sphere dressing tool 1 needs to be replaced the set screw 107 is loosened and the hollow sphere dressing tool 1 replaced. The replacement of the hollow sphere dressing tool 1 only takes a few minutes to replace. Additionally, the hollow sphere dressing tool 1 does not rotate relative to the dressing arm 102.

There is another advantage to the hollow sphere dressing tool 1 over the star cutter tool. Dressing with the star cutter tool creates a tremendous amount of stress on the dressing arm 102 of the grinding machine 100. Over time the force of the dressing process with the star cutter tool creates wear on the bearings of the dressing arm 102 and the points where it is attached to the grinding machine 100. The rebuilding of the dressing arm 102 can result in extensive machine downtime and be costly. For example, the minimum cost of rebuilding the dressing arm 102 is $10,000 for a 30" Besly double disc grinder. Because the hollow sphere dressing tool 1 cuts away the grinding wheel 106, there is a negligible amount of stress on the dressing arm.

Additionally, the purpose of a dressing tool is to cut away dull abrasive grains of a grinding wheel to obtain a desired shape to expose sharp grains on the surface of the grinding wheel. The hollow sphere dressing tool opens up the structure of the grinding wheel surface by creating a continuous spiral groove 108 in a top surface of the grinding wheel 106.

A grinding wheel operator trained to use diamond dressing tools will use the hollow sphere dressing tool 1 in the same manner. An operator trained to use the star cutter tool will need to adapt to a different process. The star cutter tool applies force to the grinding wheel in order to break out the grains of the grinding wheel to expose sharp grains. The hollow sphere dressing tool 1 is designed to cut or abrade the grains away with the cutting edges of the diamond grit 20. It would be accurate to compare the hollow sphere dressing tool 1 to using sandpaper as opposed to hammer and chisel to chisel out dull grains with the star cutter tool.

The operator should locate the high point of the grinding wheel to be dressed and begin the dress there. The first pass should be a shallow cut of 0.002 to 0.003 inches and the tool should traverse the surface at a rate where the hollow sphere dressing tool 1 is effectively removing grains in the grinding wheel 106 without force or motor load. The depth of cut is relative to the exposed cutting edges of the diamond grit 20. The larger the diamond grit 20, the greater the depth of cut. When a grinding wheel dressing operator is familiar with the hollow sphere dressing tool 1, the operator will determine the optimum depth of cut and rate of traverse of the dressing arm 102 appropriate to the specification of the grinding wheel 106. The type and size of grain, the hardness and structure of the bond and the size of the grinding wheel 106 will all have a bearing on the dressing process. Dressing the grinding wheel 106 at an appropriate speed will produce the spiral groove 108 in the grinding wheel similar to a needle groove in a vinyl record. The spiral groove 108 is necessary in that it opens the structure of the grinding wheel 106 to prepare the surface for coarse grinding.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A grinding wheel dressing tool with hollow spheres, comprising:

a tool shank includes a shank portion and a tool body, said shank portion extends from one end of said tool body; and a dressing portion formed on a top side of said tool body including a quantity of diamond grit, metal bond powder, binder and a plurality of hollow spheres, said diamond grit, said metal bond powder and said binder are mixed together to form a grit mixture, wherein said plurality of hollow spheres includes a first layer of hollow spheres adjacent to the tool shank and including at least two hollow spheres centered along a first horizontal axis, said plurality of hollow spheres further including a second layer of hollow spheres offset from the first layer of hollow spheres in a vertical direction and including at least two hollow spheres centered along a second horizontal axis which is perpendicular to the first horizontal axis, wherein an area around the plurality of hollow spheres is filled with said grit mixture.

2. The grinding wheel dressing tool with hollow spheres of claim 1, wherein:

a diameter of said hollow spheres is at least 3 mm.

3. The grinding wheel dressing tool with hollow spheres of claim 1, further comprising:

said dressing portion includes at least one additional layer of hollow spheres.

4. A grinding wheel dressing tool with hollow spheres, comprising:

a tool shank includes a shank portion and a tool body, said shank portion extends from one end of said tool body, wherein a dressing portion cavity is formed in an opposing end of said tool body;

a dressing portion formed on said opposing end of said tool body including a quantity of diamond grit, metal bond powder, binder and a plurality of hollow spheres, said dressing portion cavity is filled with metal bond powder, wherein said diamond grit, said metal bond powder and said binder are mixed together to form a grit mixture, wherein said plurality of hollow spheres includes a first layer of hollow spheres adjacent to the tool shank and including at least two hollow spheres centered along a first horizontal axis, said plurality of hollow spheres further including a second layer of hollow spheres offset from the first layer of hollow spheres in a vertical direction and including at least two hollow spheres centered along a second horizontal axis which is perpendicular to the first horizontal axis, wherein an area around the plurality of hollow spheres is filled with said grit mixture wherein said grit mixture and hollow spheres are heated and cured to form the dressing portion.

5. The grinding wheel dressing tool with hollow spheres of claim 4, wherein:

a diameter of said hollow spheres is at least 3 mm.

6. The grinding wheel dressing tool with hollow spheres of claim 4, further comprising:

said dressing portion includes at least one additional layer of hollow spheres.

7. A grinding wheel dressing tool with hollow spheres, comprising:

a tool shank includes a shank portion and a tool body, said shank portion extends from one end of said tool body;

a dressing portion formed on a top side of said tool body including a quantity of diamond grit, metal bond powder, binder and a plurality of hollow spheres, said diamond grit, said metal bond powder and said binder are mixed together to form a grit mixture, wherein said plurality of hollow spheres includes a first layer of hollow spheres adjacent to the tool shank and including at least two hollow spheres centered along a first horizontal axis, said plurality of hollow spheres further including a second layer of hollow spheres offset from the first layer of hollow spheres in a vertical direction and including at least two hollow spheres centered along a second horizontal axis which is perpendicular to the first horizontal axis, wherein an area around the plurality of hollow spheres is filled with said grit mixture, wherein when said dressing portion is brought in contact with a grinding wheel, said hollow spheres break causing a groove to be formed on a surface of the grinding wheel.

8. The grinding wheel dressing tool with hollow spheres of claim 7, wherein:

a diameter of said hollow spheres is at least 3 mm.

9. The grinding wheel dressing tool with hollow spheres of claim 7, further comprising:

said dressing portion includes at least one additional layer of hollow spheres.

* * * * *